US007730685B1

(12) United States Patent
Keene

(10) Patent No.: US 7,730,685 B1
(45) Date of Patent: Jun. 8, 2010

(54) MORTAR AND DEBRIS COLLECTION SYSTEM FOR MASONRY CAVITY WALLS

(75) Inventor: James R. Keene, Pepper Pike, OH (US)

(73) Assignee: Keene Building Products Co., Inc., Mayfield Heights, OH (US)

( * ) Notice: Subject to any disclaimer, the term of this patent is extended or adjusted under 35 U.S.C. 154(b) by 1943 days.

(21) Appl. No.: 10/733,595

(22) Filed: Dec. 11, 2003

(51) Int. Cl.
*E04B 2/28* (2006.01)
*E04B 1/70* (2006.01)
*E04F 17/00* (2006.01)

(52) U.S. Cl. ..... 52/302.4; 52/169.5; 52/302.1; 52/302.6

(58) Field of Classification Search ..... 52/302.3, 52/302.6, 169.5, 379, 513, 408, 302.5, 561, 52/302.4; 210/508
See application file for complete search history.

(56) References Cited

U.S. PATENT DOCUMENTS

| | | | | | |
|---|---|---|---|---|---|
| 1,746,816 | A | | 2/1930 | Boes | 52/607 |
| 1,954,730 | A | | 4/1934 | Erickson | 72/41 |
| 2,213,355 | A | | 9/1940 | Woodworth | 72/16 |
| 2,298,319 | A | | 10/1942 | Vatet | 72/127 |
| 2,329,585 | A | | 9/1943 | Brewer | 72/127 |
| 2,634,601 | A | | 4/1953 | Tillery | 72/16 |
| 2,705,887 | A | | 4/1955 | Xanten | 72/128 |
| 2,897,109 | A | | 7/1959 | Voigtman | 154/50 |
| 2,934,931 | A | | 5/1960 | Johnson | 72/5 |
| 3,277,626 | A | | 10/1966 | Brynjolfsson et al. | 52/713 |
| 3,293,810 | A | | 12/1966 | Cox et al. | 52/303 |
| 3,562,982 | A | | 2/1971 | Parezo | 52/169 |
| 3,668,829 | A | | 6/1972 | Nelson | 52/169 |
| 3,686,049 | A | | 8/1972 | Manner et al. | 156/167 |
| 3,687,759 | A | | 8/1972 | Werner et al. | 156/167 |
| 3,691,004 | A | * | 9/1972 | Werner et al. | 428/219 |
| 3,788,017 | A | | 1/1974 | Bachus | 52/122 |
| 3,837,988 | A | * | 9/1974 | Hennen et al. | 428/92 |
| 3,999,349 | A | | 12/1976 | Miele et al. | 52/568 |
| 4,010,748 | A | | 3/1977 | Dobritz | 128/192 |
| 4,102,093 | A | | 7/1978 | Harris | 52/101 |
| 4,212,692 | A | | 7/1980 | Rasen et al. | 156/167 |
| 4,282,691 | A | | 8/1981 | Risdon | 52/101 |
| 4,315,392 | A | | 2/1982 | Sylvest | 52/309.1 |
| 4,333,281 | A | | 6/1982 | Scarfone | 52/169.5 |
| 4,351,683 | A | * | 9/1982 | Kusilek | 156/167 |
| 4,381,630 | A | | 5/1983 | Koester | 52/169.5 |
| 4,422,271 | A | | 12/1983 | Anzinger | 52/302 |
| 4,606,163 | A | | 8/1986 | Catani | 52/434 |
| 4,622,138 | A | * | 11/1986 | Wager | 405/45 |
| 4,660,342 | A | | 4/1987 | Salisbury | 52/358 |
| 4,827,684 | A | | 5/1989 | Allan | 52/378 |
| 4,852,320 | A | | 8/1989 | Ballantyne | 52/303 |

(Continued)

FOREIGN PATENT DOCUMENTS

CA 2 527 467 * 5/2006

*Primary Examiner*—Robert J Canfield
(74) *Attorney, Agent, or Firm*—Renner, Otto, Boisselle & Sklar, LLP

(57) ABSTRACT

A mortar and debris collection device for insertion into lower portions of a cavity defined between outer and inner wall structures of a masonry cavity wall employs two relatively rigid mat elements each designed to permit moisture to pass readily therethrough. Bottom edge regions of the two mat elements are hinge connected to permit the mat elements to be folded into closely overlying relationship.

35 Claims, 6 Drawing Sheets

U.S. PATENT DOCUMENTS

| | | | | | |
|---|---|---|---|---|---|
| 4,875,319 | A | | 10/1989 | Hohmann | 52/383 |
| 4,907,385 | A | | 3/1990 | Biodrowski | 52/169.5 |
| 4,910,931 | A | | 3/1990 | Pardue, Jr. | 52/169.5 |
| 5,099,627 | A | | 3/1992 | Coulton et al. | 52/408 |
| 5,115,614 | A | | 5/1992 | McGrath | 52/169.5 |
| 5,167,579 | A | * | 12/1992 | Rotter | 454/365 |
| 5,207,043 | A | | 5/1993 | McGee et al. | 52/379 |
| 5,230,189 | A | | 7/1993 | Sourlis | 52/169.5 |
| 5,230,192 | A | | 7/1993 | Webb et al. | 52/395 |
| 5,274,968 | A | | 1/1994 | Pardo | 52/97 |
| 5,343,661 | A | | 9/1994 | Sourlis | 52/169.5 |
| 5,456,876 | A | * | 10/1995 | Redwine et al. | 264/555 |
| 5,489,462 | A | | 2/1996 | Sieber | 428/174 |
| 5,598,673 | A | | 2/1997 | Atkins | 52/302.1 |
| 5,634,310 | A | | 6/1997 | Hohmann | 52/513 |
| 5,692,348 | A | | 12/1997 | Ambrosino | 52/169.5 |
| 5,768,842 | A | | 6/1998 | Austin | 52/302.3 |
| 5,826,390 | A | | 10/1998 | Sacks | 52/408 |
| 5,845,455 | A | | 12/1998 | Johnson, III | 52/713 |
| 5,860,259 | A | * | 1/1999 | Laska | 52/302.3 |
| 5,934,995 | A | * | 8/1999 | Morris et al. | 454/365 |
| 5,937,594 | A | | 8/1999 | Sourlis | 52/169.5 |
| 5,947,817 | A | * | 9/1999 | Morris et al. | 454/365 |
| 6,023,892 | A | * | 2/2000 | Sourlis | 52/169.5 |
| RE36,676 | E | | 5/2000 | Sourlis | 52/169.5 |
| 6,067,781 | A | * | 5/2000 | Ford et al. | 54/66 |
| 6,112,476 | A | | 9/2000 | Schulenburg | 52/169.5 |
| 6,131,353 | A | * | 10/2000 | Egan | 52/408 |
| 6,167,668 | B1 | | 1/2001 | Fine et al. | 52/403.1 |
| 6,241,421 | B1 | * | 6/2001 | Harvie et al. | 405/45 |
| 6,256,955 | B1 | | 7/2001 | Lolley et al. | 52/302.3 |
| 6,474,031 | B2 | | 11/2002 | Phillips | 52/302.1 |
| 6,584,746 | B1 | | 7/2003 | Hohmann et al. | 52/513 |
| 6,662,504 | B2 | | 12/2003 | Krogstad | 52/61 |
| 6,684,579 | B2 | | 2/2004 | Brunson et al. | |
| 6,883,284 | B1 | * | 4/2005 | Burgunder et al. | 52/302.1 |
| 7,481,921 | B2 | * | 1/2009 | Kent | 210/164 |
| 7,526,900 | B2 | * | 5/2009 | Ehrman et al. | 52/302.3 |
| 2003/0126810 | A1 | * | 7/2003 | Brunson et al. | 52/169.5 |
| 2004/0003558 | A1 | * | 1/2004 | Collins et al. | 52/302.1 |
| 2005/0055983 | A1 | * | 3/2005 | Tomes | 52/782.1 |
| 2005/0247611 | A1 | * | 11/2005 | Groth et al. | 210/162 |
| 2006/0117687 | A1 | * | 6/2006 | Ehrman et al. | 52/302.1 |

* cited by examiner

MORTAR AND DEBRIS COLLECTION SYSTEM FOR MASONRY CAVITY WALLS

BACKGROUND OF THE INVENTION

The present invention relates to the construction of masonry "cavity" walls of the type that have an outer wall structure formed from masonry components set in mortar, and an inner wall structure that is separated from the outer wall structure by an air space cavity from which moisture is vented by weep vent passages formed through lower portions of the outer wall structure. More particularly, the present invention relates to the provision and use of a foldable mortar and debris collection device for insertion into lower portions of the air space cavity of masonry cavity walls for preventing the obstruction of drainage weep vent passages by wet and dry mortar droppings and sizable construction debris during and after construction.

So-called "masonry cavity walls" have outer wall structures formed from masonry elements such as bricks, concrete blocks, tiles, stones and the like that are set in mortar, and inner wall structures that are separated from the outer wall structures by a space of typically about one to about five inches. The space between the inner and outer wall structures is referred to as an "air space cavity" or, more simply, as a "cavity." If the space between the inner and outer wall structures of a masonry cavity wall is two inches, the air space cavity is said to have a "width" of two inches. Masonry cavity walls typically have cavities that range in width from about one inch to about five inches, with a range of about one inch to about three inches being most common.

As is well known, moisture tends to form in the air space cavity of a masonry cavity wall, and tends to collect in lowermost portions of the cavity. If collected moisture is allowed to remain within the air space cavity, damage may be caused as adjacent and nearby construction materials become damp. This damage may range from cosmetic discoloration to rot, disintegration and structural weakening that may require costly repair and replacement.

Providing weep vent passages that extend through the outer wall structure, especially through lowermost portions of the outer wall structure, can do much to ventilate and to drain moisture from the air space cavity of a masonry wall. However, weep vent passages will not perform their intended function if they are obstructed, or if moisture is blocked from moving through lower and lowermost portions of the air space cavity to reach the weep vent passages.

To prevent mortar and construction debris from collecting in lowermost portions of masonry wall cavities where it may obstruct or block moisture from entering and discharging through weep vent passages intended to drain moisture from lowermost cavity portions, a variety of types of collectors and deflectors have been proposed for insertion into air space cavities. In U.S. Pat. Nos. 2,705,887 and 5,845,455, for example, V-shaped troughs of solid construction are disclosed for collecting mortar and debris at locations above where weep vent passages open into lower portions of the outer wall structures of masonry cavity walls.

Other proposals, such as those disclosed in U.S. Pat. Nos. RE-36,676, 6,256,955, 6,023,892, 5,937,594, 5,598,673, 5,343,661 and 5,230,189, employ mats formed from polymer filaments that twist and turn like the filaments of furnace air filters—single-thickness mats that are inserted into lower portions of the air space cavities of mortar cavity walls to collect or deflect mortar droppings and debris while also defining networks of passages through which moisture can travel downwardly toward weep vent passage openings for discharge through the weep vent passages. The single-thickness mats proposed by others do not utilize mat elements that are connected by flexible hinge formations, nor do these single-thickness mats "unfold" after being inserted into masonry wall cavities.

Some open-space, filament-formed, mat-type mortar and debris collector proposals call for the mats to have thicknesses that substantially equal the widths of the air space cavities into which these mat-type collectors are inserted, so that mortar and debris will be prevented from passing downwardly alongside the mats, and thus will be prevented from accumulating adjacent weep vent passage openings. Providing mats that have the same thicknesses as the cavities into which they are inserted can present difficulties inasmuch as these cavities are not all of the same width, and, in fact, may vary considerably in width. If a mat is too thick to fit into a particular cavity, forcing it into the cavity can cause unwanted displacement of newly laid masonry elements.

Some open-space, filament-formed, mat-type mortar and debris collector proposals call for mats that are substantially thinner than the widths of the cavities in which they are inserted, with the mats being intended to lean either forwardly or rearwardly within the cavities so as to bridge the widths of the cavities to thereby catch mortar droppings and construction debris while simultaneously permitting moisture to pass therethrough. The use of thin, single-thickness mats that lean or are otherwise positioned to bridge the widths of the air space cavities in which they are installed has not proved to be adequately reliable. Some of these mats fail to support the weight of accumulated mortar droppings and debris. Some are found to move out of their installed positions when struck by mortar droppings or construction debris, which has been found to permit other mortar droppings and debris to pass by the mats and come to rest in positions where they block or obstruct weep vent passage openings.

BRIEF SUMMARY OF THE INVENTION

The present invention addresses the foregoing and other needs and drawbacks of the prior art by providing a mortar and debris collector device for insertion into lower portions of the cavity of a masonry cavity wall, wherein the device employs two relatively rigid mat elements each of which permits moisture to pass readily therethrough while preventing sizable mortar droppings and construction debris from passing therethrough. The two relatively rigid mat elements have bottom edge regions connected by flexible hinge formations that permit the device to be folded to bring the mat elements into closely overlying relationship for insertion in a hinge-formation-down orientation into lower portions of the cavity of a masonry cavity wall where the mat elements unfold to define an upwardly opening trough of substantially V-shaped cross-section for catching sizable mortar droppings and construction debris at locations spaced from where weep vent passages formed through the outer wall structure of the masonry cavity wall open into lowermost portions of the cavity.

To ensure that the mat elements of the device can properly unfold to form a V-shaped trough, the combined thickness of the folded device (i.e., when the mat elements have been folded about the hinge formation to overlie each other to ready the device for insertion into a wall cavity) is less than eighty percent of the width of the wall cavity into which the folded device is inserted. To aid the mat elements in guiding mortar droppings and debris into the upwardly opening V-shaped trough (of the inserted, unfolded device) to a central collection location (that is spaced by the mat elements from the inner and outer walls and spaced above the bottom of the wall cavity), upper edge regions of the mat elements are tapered to point upwardly, instead of being flat so as to define top surfaces that collect mortar and debris at locations adjacent the inner and outer walls where top surfaces of previously proposed mortar collection devices have been designed to collect mortar droppings.

The pointed upper edges of the mat elements of the present invention are designed not to collect mortar droppings adjacent the inner and outer wall structures that define opposite sides of the wall cavity—an arrangement designed to ensure that droppings and debris collect mainly in a central collection location provided by the upwardly opening trough of V-shaped cross-section defined between the unfolded mat elements of the inserted device—an arrangement that enables ventilation air to circulate through the mat elements along the cavity defining faces of the inner and outer wall structures, and that permits moisture to travel downwardly through the mat elements along paths of travel located forwardly and rearwardly of the collection cavity as defined by the moisture pervious mat elements. In this manner, moisture travels through the wall cavity toward the weep vent openings for discharge from the cavity through the weep vent passages.

Unlike the solidly constructed V-shaped trough-type collectors proposed by others which can collect moisture and obstruct its downward migration through a masonry wall cavity, the upwardly opening V-shaped through collectors of the present invention permit moisture to pass readily therethrough and hence do not obstruct the downward migration of moisture toward weep vent passage openings. The open construction of the mat elements also permits air to circulate through the wall cavity, with paths for the easy passage of ventilation air being provided along the front and rear wall structures (i.e., along opposite sides of the central chamber where droppings and debris collect in the upwardly opening V-shaped trough defined between the inserted, unfolded mat elements of the device of the present invention).

An advantage 1) that obtains from the use of pointed upper edges on the mat elements that guide mortar droppings and construction debris into a central collection chamber defined by the V-shaped trough between the mat elements, and 2) that obtains by eliminating the use of flat, substantially horizontally extending upper surfaces of mat elements that tend to collect droppings and debris adjacent one or both of the inner and outer wall structures (as is common in the prior art), is that collected mortar droppings and construction debris tend not to collect atop the mortar collection device (as is intended with prior art devices) and are prevented from bridging the full width of the wall cavity between the inner and outer wall structures (as also is commonly encountered with prior art devices). Thus, ventilation air tends to circulate more freely in wall cavities that employ the device of the present invention.

If membrane flashing or other flashing material that can be damaged by being struck by falling debris or mortar droppings is utilized at or near the bottom of a wall cavity that carries the mortar and debris collector of the present invention, the flashing will be protected by the collector because droppings and debris are collected at a central location and at height spaced above the bottom of the cavity (i.e., within the V-shaped trough defined by the mat elements of the inserted collector). The mat elements come increasingly closely into engagement as the V-shaped trough narrows near its bottom, and preferably engage each other at the bottom of the V-shaped trough so that very little, if any, droppings or debris actually pass through the trough or are permitted to engage flashing located at or near the bottom of the wall cavity.

In preferred practice, a mortar and debris collection device includes substantially rigid, substantially flat, first and second mat elements that have bottom edge regions connected by a flexible hinge formation that permits the first and second mat elements to move relative to each other about the flexible hinge formation to a folded position wherein the first and second mat elements closely overlie each other so that the tightly folded device has a maximum insertion thickness that is less than eighty percent of the width of the wall cavity into which it is to be inserted. After the folded device is inserted into lower portions of a masonry wall cavity between outer and inner wall structures of the masonry wall in a hinge-formation-down orientation, the first and second mat elements of the inserted device unfold to define an upwardly opening trough of substantially V-shaped cross section, with upper edge portions of the mat elements coming to rest in engagement with opposed cavity-facing surfaces of the outer and inner wall structures to guide mortar droppings and construction debris downwardly into the V-shaped trough to a central collection location spaced from the inner and outer wall structures, and spaced above the bottom of the wall cavity to keep collected droppings and debris away from where weep vent passages formed through the outer wall structure open into lowermost portions of the cavity. The stiffness or "memory" of the material of the hinge formation may be utilized to assist the mat elements to unfold after the folded device has been inserted into lower portions of the cavity of a masonry wall.

In preferred practice, the first and second mat elements each have at least a portion thereof defined by polymer filaments that twist and turn between junctures where adjacent filaments are connected so as to define open-space structures through which moisture can pass on its way toward the weep vent passage openings. In most preferred practice, the first and second mat elements are defined substantially entirely by polymer filaments that twist and turn randomly between randomly located junctures where adjacent filaments are heat bonded so as to define substantially rigid open-space mat elements that permit moisture to pass readily therethrough, but that catch sizable mortar droppings and construction debris and direct the droppings and debris into the V-shaped trough defined between the mat elements. Only a relatively few droppings of very small size, and only particle-size construction debris are permitted to pass through the mat elements themselves.

In preferred practice, the first and second mat elements have substantially equal lengths (measured horizontally along the length of a wall cavity into which the mat elements of a collection device have been inserted); and have first and second widths (measured transverse to mat length as the distance from the hinge formation to the pointed edge regions of the mat elements) that may be unequal or equal. The "widths" of the mat elements are the vertical dimensions of the mat elements after the collection device has been inserted, while folded, into lower portions of a wall cavity, and these vertical dimensions or vertical heights of the mat elements may be equal or unequal.

In preferred practice, the mat elements used to form a particular mortar and debris collector are each of a substantially uniform, substantially equal thickness except where their pointed upper edge regions are defined, and perhaps also in the vicinity of their bottom edge regions where a hinge formation is provided to flexibly connect the bottom edge regions of the mat elements. However, it is not essential that the mat elements be of uniform or equal thickness, or that the cross-sections the mat elements of a collector be identical or similar to each other—so long as, when the mat elements of the collector are folded together for insertion into a wall cavity, their combined folded-together thickness does not exceed eighty percent of the width of the wall cavity (an arrangement that ensures that the mat elements of the collector can properly unfold to form an upwardly opening V-shaped trough after the folded collector has been inserted into lower portions of the wall cavity of a masonry wall.

While the pointed upper edge regions of the mat structures of collectors that embody the present invention can take a variety of specific configurations while still serving to not provide a surface or surfaces that tend to catch or retain mortar droppings and debris thereon, it is desirable that the pointed upper edge regions also be configured to assist somewhat in guiding or directing mortar droppings and construction debris into the upwardly opening V-shaped trench defined centrally between the unfolded mat elements. The most preferred configuration for the pointed upper edge regions results when tangled arrays of polymer fibers are used to form the mat elements, and when the fibers that form the pointed upper edge regions cooperate to define substantially planar outer surfaces that intersect at acute included angles of between about forty five degrees to about thirty degrees.

A simple way to provide mat elements that have pointed upper edge regions of the most preferred configuration is to make a single, substantially planar, inclined cut through a uniform-thickness sheet of tangled polymer filament material so as to create two mat elements, each of which has a pointed edge, with the surfaces that define each of the pointed edges extending planes that intersect at substantially equal acute included angles of preferably less than forty-five degrees, and preferably greater than thirty degrees. When mat elements formed in the manner just described have their bottom edge regions (i.e., the edge regions that are opposite the pointed upper edge regions) joined by a flexible hinge formation, the mat elements should be arranged so that, when they unfold after the resulting collector has been inserted into lower portions of a cavity between inner and outer wall structures, the "points" of the pointed upper edge regions will extend into engagement with cavity-facing surfaces of the inner and outer wall structures so that the pointed upper edge regions will serve to guide falling droppings and debris away from the outer and inner wall structures and into the centrally located V-shaped cavity defined between the mat elements.

In preferred practice, the mat element that is located nearest to the inner wall structure has a width (or vertical height) of at least about ten inches so it will overlie and shield membrane flashing or other flashing material that may extend along or line the lower ten inches of the inner wall structure. The membrane flashing or other flashing material also may extend across or line the bottom of the wall cavity and, if present at the bottom of the wall cavity, is also shielded from being impacted by droppings and debris because these things are caught at a height above the bottom of the wall cavity (i.e., within the V-shaped trough of the collector).

The hinged dual-mat collector structures of the present invention may utilize a variety of hinge formations and variety of hinge placements in establishing lines of weakness or in providing other forms of flexible hinges that couple a pair of mat elements. In one embodiment, a relatively thin reach of material such as about a 0.1 inch thick mat of unwoven but entangled glass or polymer fibers may overlap and be bonded to adjacent bottom edge portions of first and second mat elements to provide a substantially continuous, substantially uninterrupted flexible hinge connection that extends along substantially the full length of both mat elements; or may be provided at spaced locations along adjacent bottom edge portions of the first and second mats to provide a discontinuous, interrupted flexible hinge connection therebetween. The stiffness or "memory" of the material of the hinge formation may be utilized to assist the mat elements to unfold after the folded device has been inserted into lower portions of the cavity of a masonry wall.

In another embodiment, a one-piece collector may be formed from a mat formed from polymer filaments that twist and turn at random between randomly located intersections where adjacent filaments are connected. To form a two-mat-element collector device having a flexible hinge formation that joins the two mat elements, filaments that bridge between two regions of the one-piece mat are clamped together and bonded while clamped so as to form a thin flexible hinge region that permits the mat elements to be folded into overlying relationship for insertion, and that permits the mat elements to unfold after being inserted into lower portions of a masonry wall cavity to enable pointed upper edges of the mat elements to engage cavity-facing surfaces of outer and inner wall structures of the masonry cavity wall. If desired, selected regions of the thin flexible hinge area may be cut, or openings may be provided, to further weaken the region of the thin flexible hinge, so long as the cuts or openings do not permit significant droppings and debris to pass through the V-shaped trough to impact and damage such flashing as may line the bottom of the wall cavity. Bottom edge regions of the mat elements that may be compressed somewhat when the mat elements are folded into closely overlying relationship for insertion into a wall cavity may be utilized to assist the mat elements to unfold after a collector device has been inserted (while tightly folded) into the wall cavity, and/or the stiffness or "memory" of the material of the hinge formation may be utilized to assist the mat elements to unfold after the folded device has been inserted into lower portions of the cavity of a masonry wall.

In other embodiments, hinge formations may be provided between two mat elements by using flexible members that have edge regions which are inserted into and bonded to adjacent edge regions of two mat elements, with the flexible members permitting the relatively stiff or rigid mat members to be folded to a side-by-side orientation having a maximum combined thickness for insertion (i.e., an "insertion thickness") of less than eighty percent of the width of a wall cavity before being inserted in a hinge-down attitude into the lower portions of the wall cavity, with the hinged mat elements unfolding after insertion so pointed upper edges of the mat elements engage opposed cavity-facing surfaces of the inner and outer wall structures of the masonry cavity wall for guiding droppings and debris into the upwardly opening trough defined between the mat elements.

In still other embodiments, a sheet of polymer filament open-space mat material may be weakened along a location where a flexible hinge formation is to be formed by providing cuts therethrough. Mat material that remains in tact (i.e., mat filaments that are left in tact between the cuts or openings that weaken the central region) may be further weakened as by heat bonding the filaments thereof while these filaments are being clamped, to provide thin mat portions that bend easily so as to ensure that, when the mat is folded and installed, it will not (when unfolded to define an upwardly opening V-shaped trough) exert undue pressure on newly laid brick, block, tile, stone or other masonry elements laid in mortar.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF PREFERRED EMBODIMENTS

Figure 1:
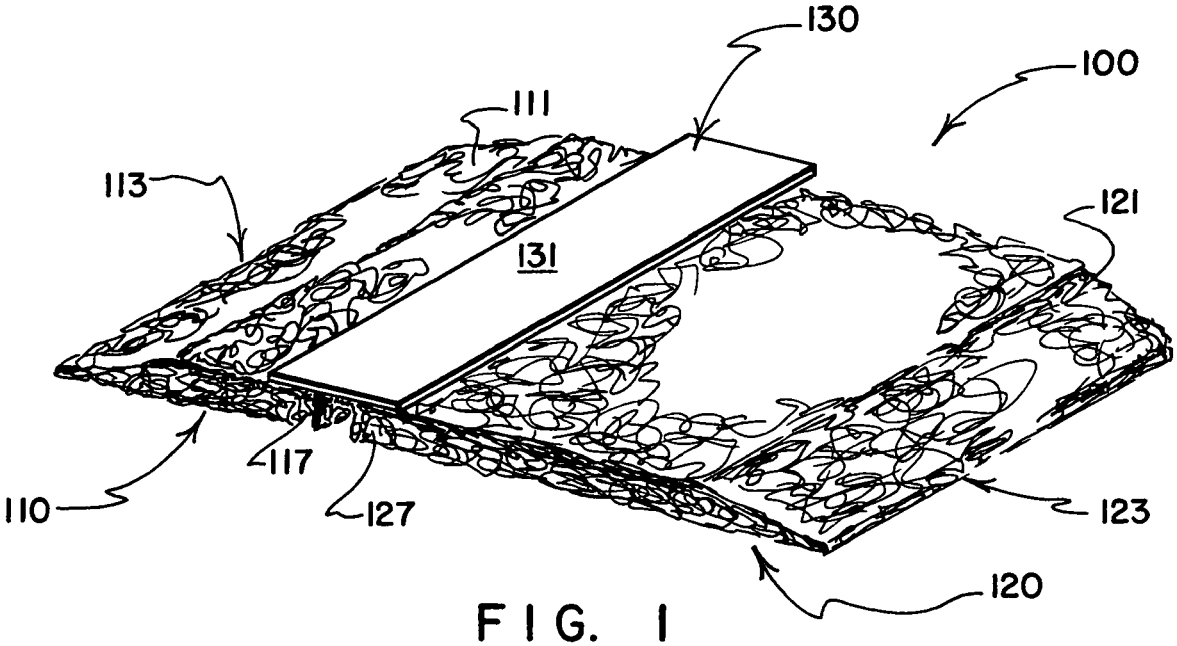
FIG. 1 is a perspective view of a first form of foldable mortar and debris collector that embodies features of the present invention, with the collector shown in a flat, unfolded orientation with its two relatively rigid mat elements extending in substantially a common plane and having edge regions of the relatively rigid mat elements flexibly connected by an overlying reach of thin flexible material that is bonded to the edge regions to provide a flexible hinge formation that permits the collector to be folded.

Referring to FIG. 1, a mortar and debris collector embodying a first form of the present invention is indicated generally by the numeral 100. The collector 100 has mat elements 110, 120 that are connected by a flexible hinge formation 130 which permits the collector 100 to be folded to bring the mat elements 110, 120 into side-by-side engagement for insertion into a masonry wall cavity which is indicated generally by the numeral 140 in FIG. 2. The mat elements 110, 120 have pointed upper edge regions 111, 121 that terminate in pointed formations or "points" 113, 123; and have lower edge regions 117, 127 that are connected by the flexible hinge formation 130.

Figure 3:
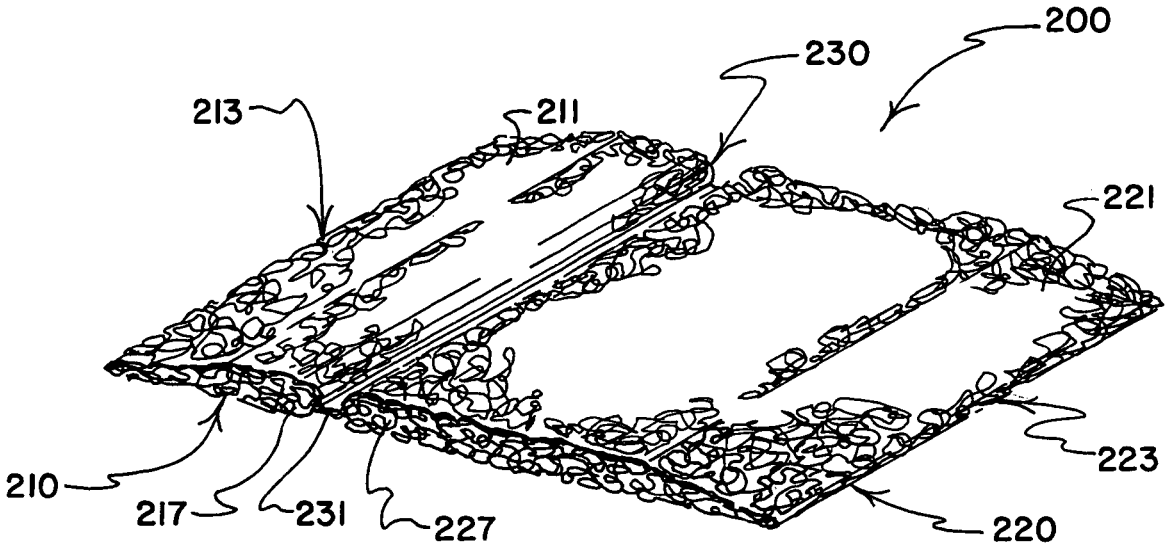
FIG. 3 is a perspective view of a second form of foldable mortar and debris collector that embodies features of the present invention, with the collector shown in a flat orientation with its two relatively rigid mat elements extending in substantially a common plane and with flexible filaments that extend between adjacent edge regions of the two relatively rigid mat elements being bonded together to provide a flexible hinge formation that permits the collector to be folded.

Referring to FIG. 3, a mortar and debris collector embodying a second form of the present invention is indicated generally by the numeral 200. The collector 200 has mat elements 210, 220 that are connected by a flexible hinge formation 230 which permits the collector 200 to be folded to bring the mat elements 210, 220 into side-by-side engagement for insertion into a masonry wall cavity which is indicated generally by the numeral 240 in FIG. 4. The mat elements 210, 220 have pointed upper edge regions 211, 221 that terminate in pointed formations or "points" 213, 223; and have lower edge regions 217, 227 that are connected by the flexible hinge formation 230.

Figure 5:
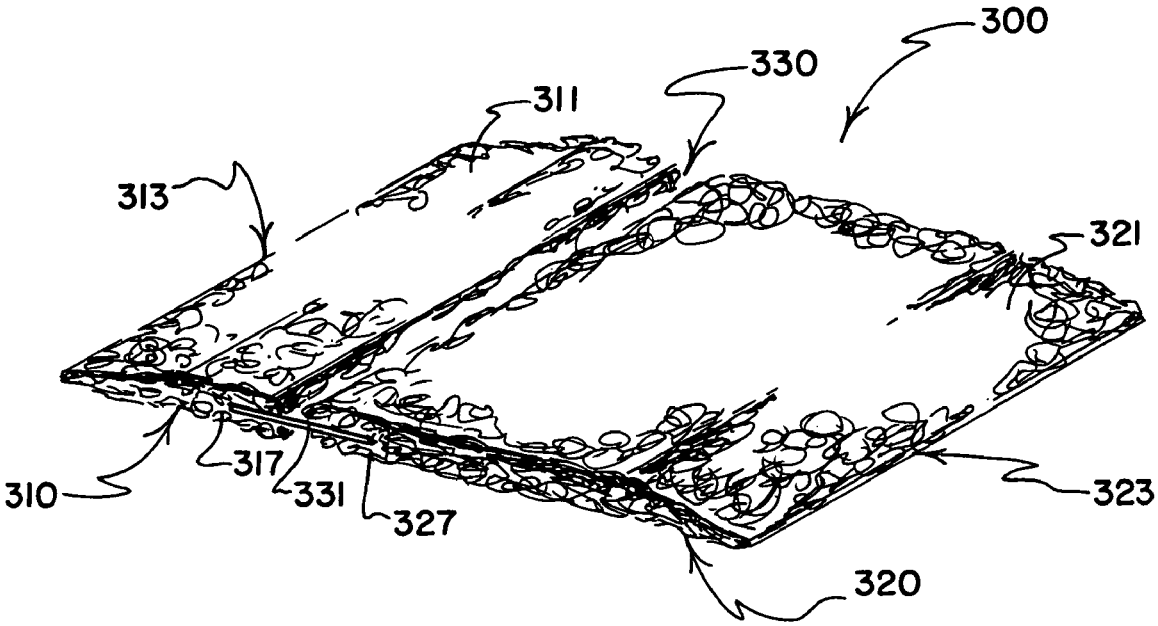
FIG. 5 is a perspective view of a third form of foldable mortar and debris collector that embodies features of the present invention, with the collector shown in a flat orientation with its two relatively rigid mat elements extending in substantially a common plane and having edge regions of the mat elements flexibly connected by a reach of thin flexible material that extends into and is bonded to the edge regions to provide an interrupted flexible hinge formation that permits the collector to be folded.

Referring to FIG. 5, a mortar and debris collector embodying a third form of the present invention is indicated generally by the numeral 300. The collector 300 has mat elements 310, 320 that are connected by a flexible hinge formation 330 which permits the collector 300 to be folded to bring the mat elements 310, 320 into side-by-side engagement for insertion into a masonry wall cavity which is indicated generally by the numeral 340 in FIG. 6. The mat elements 310, 320 have pointed upper edge regions 311, 321 that terminate in pointed formations or "points" 313, 323; and have lower edge regions 317, 327 that are connected by the flexible hinge formation 330.

Figure 7:
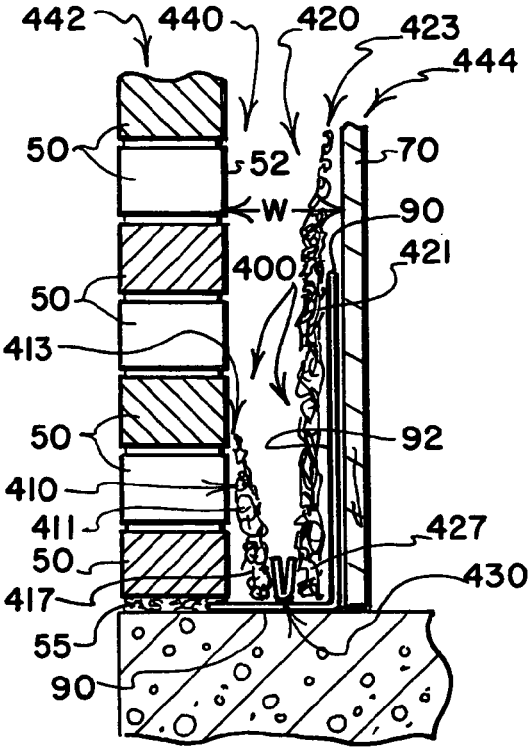
FIG. 7 is a cross-sectional view similar to FIG. 1 but with the ratio of widths of the mat members being altered from the 1:2 ratio depicted in FIGS. 1, 3 and 5 to a 1:3 ratio, with some of the elements shown spaced apart merely to enable their individual cross-sections to be viewed and distinguished one from another.

Referring to FIG. 7, a mortar and debris collector embodying a fourth form of the present invention is indicated generally by the numeral 400. The collector 400 has mat elements 410, 420 that are connected by a flexible hinge formation 430 which permits the collector 400 to be folded to bring the mat elements 410, 420 into side-by-side engagement for insertion into a masonry wall cavity which is indicated generally by the numeral 440. The mat elements 410, 420 have pointed upper edge regions 411, 421 that terminate in pointed formations or "points" 413, 423; and have lower edge regions 417, 427 that are connected by the flexible hinge formation 430.

Figure 8:
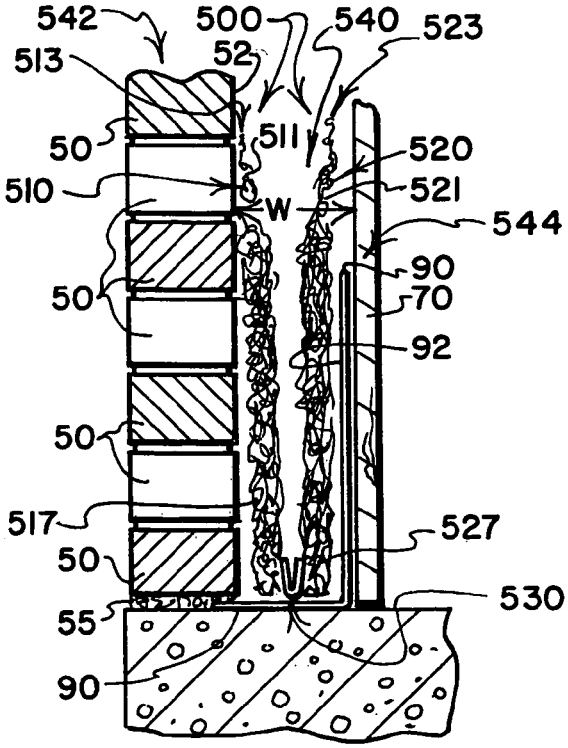
FIG. 8 is a cross-sectional view similar to FIGS. 1 and 7 but with the ratio of widths of the mat members being 1:1 so as to illustrate that the mat members may, if desired, be of substantially equal width, with some of the elements spaced apart to enable their individual cross-sections to be distinguished one from another.

Referring to FIG. 8, a mortar and debris collector embodying a fifth form of the present invention is indicated generally by the numeral 500. The collector 500 has mat elements 510, 520 that are connected by a flexible hinge formation 530 which permits the collector 500 to be folded to bring the mat elements 510, 520 into side-by-side engagement for insertion into a masonry wall cavity which is indicated generally by the numeral 540. The mat elements 510, 520 have pointed upper edge regions 511, 521 that terminate in pointed formations or "points" 513, 523; and have lower edge regions 517, 527 that are connected by the flexible hinge formation 530.

Figure 9:
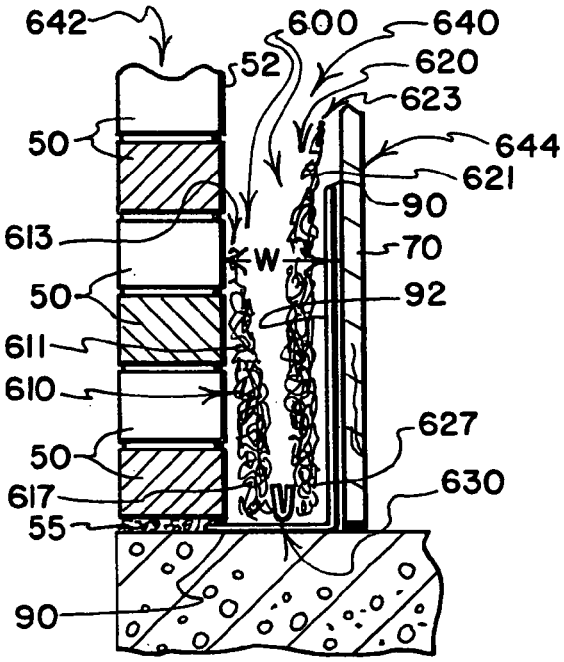
FIG. 9 is a cross-sectional view similar to FIGS. 1 and 7 showing that mat elements that are thicker than those depicted in other FIGURES may be employed, if desired, with some of the elements spaced apart to enable their cross-sections to be distinguished one from another.

Referring to FIG. 9, a mortar and debris collector embodying a sixth form of the present invention is indicated generally by the numeral 600. The collector 600 has mat elements 610, 620 that are connected by a flexible hinge formation 630 which permits the collector 600 to be folded to bring the mat elements 610, 620 into side-by-side engagement for insertion into a masonry wall cavity which is indicated generally by the numeral 640. The mat elements 610, 620 have pointed upper edge regions 611, 621 that terminate in pointed formations or "points" 613, 623; and have lower edge regions 617, 627 that are connected by the flexible hinge formation 630.

Figure 10:
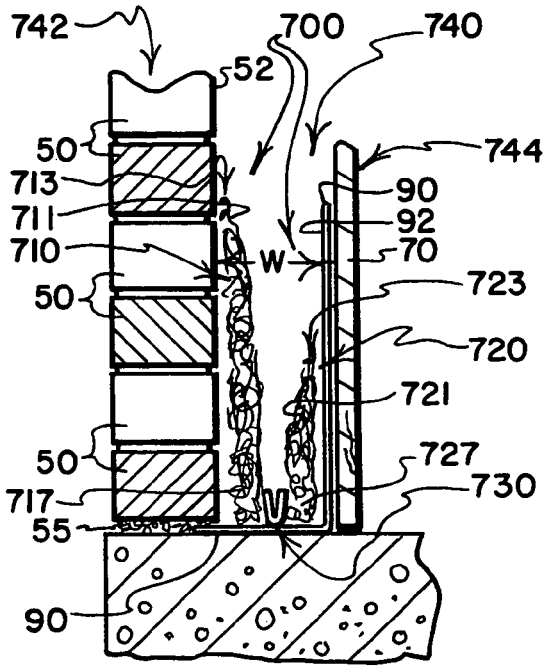
FIG. 10 is a cross-sectional view similar to FIG. 1 but with the collector turned around so that its narrower leg is adjacent the inner wall structure, and so that its wider leg is adjacent the outer wall structure, with some of the elements spaced apart merely to enable their cross-sections to be distinguished one from another.

Referring to FIG. 10, a mortar and debris collector embodying a seventh form of the present invention is indicated generally by the numeral 700. The collector 700 has mat elements 710, 720 that are connected by a flexible hinge formation 730 which permits the collector 700 to be folded to bring the mat elements 710, 720 into side-by-side engagement for insertion into a masonry wall cavity which is indicated generally by the numeral 740. The mat elements 710, 720 have pointed upper edge regions 711, 721 that terminate in pointed formations or "points" 713, 723; and have lower edge regions 717, 727 that are connected by the flexible hinge formation 730.

Figure 11:
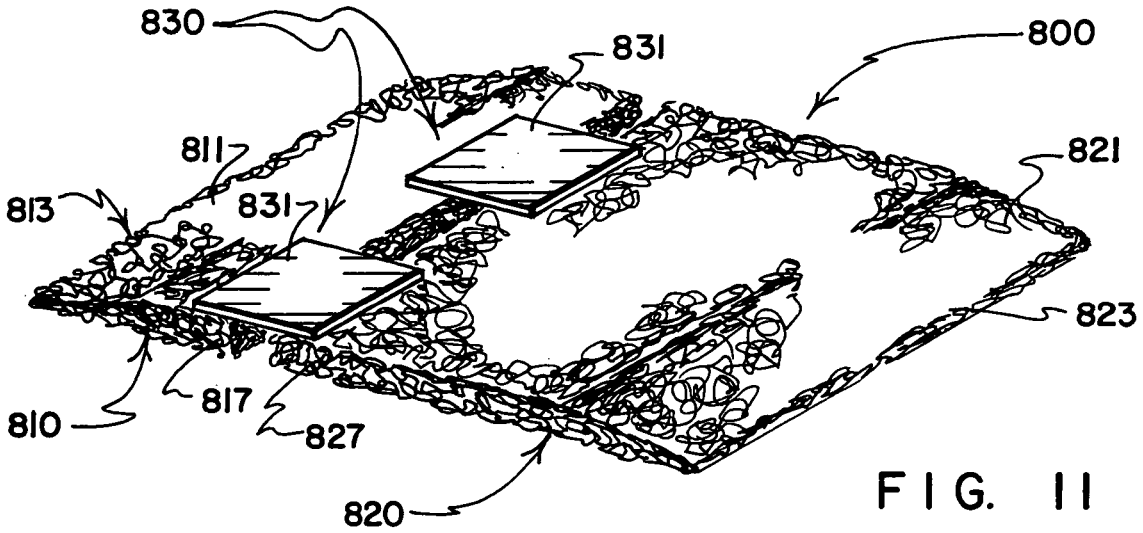
FIG. 11 is a perspective view similar to FIG. 1 but utilizing spaced reaches of flexible overlapping material to establish a discontinuous or interrupted flexible hinge between the mat elements.

Referring to FIG. 11, a mortar and debris collector embodying an eighth form of the present invention is indicated generally by the numeral 800. The collector 800 has mat elements 810, 820 that are identical to the mat elements 110, 120 of FIG. 1 and that are connected by a plurality of flexible members 831 that cooperate to define a flexible hinge formation 830 that is a discontinuous or interrupted adaptation of the continuous, uninterrupted flexible hinge formation 130 of FIG. 1, and that permits the collector 800 to be folded to bring the mat elements 810, 820 into side-by-side engagement for insertion into a masonry wall cavity, such as the cavity 140 depicted in FIG. 2. The mat elements 810, 820 have pointed upper edge regions 811, 821 that terminate in pointed formations or "points" 813, 823; and have lower edge regions 817, 827 that are connected by the flexible hinge formation 830.

Figure 12:
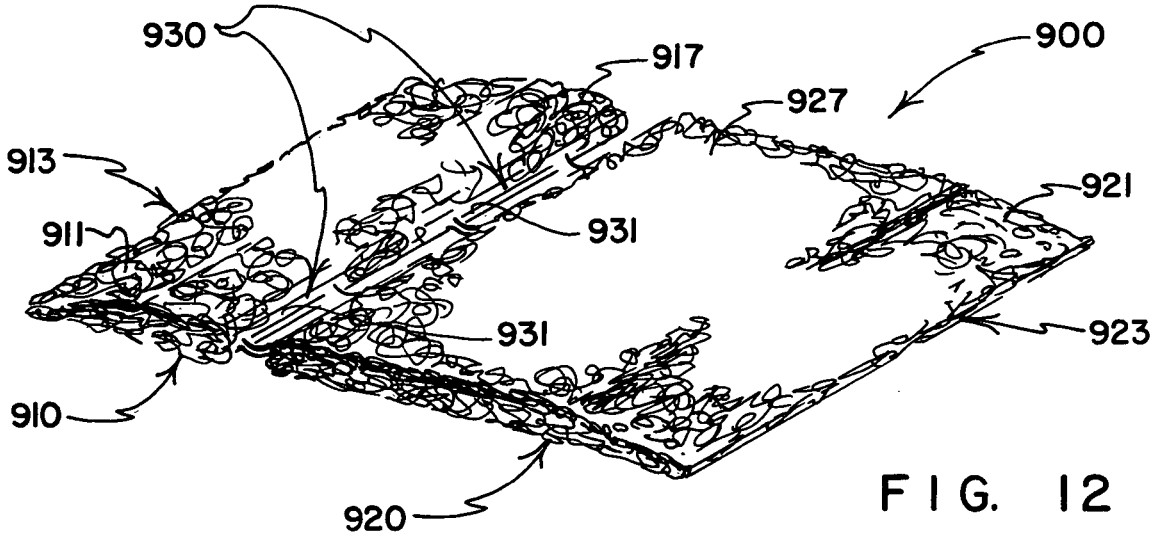
FIG. 12 is a perspective view similar to FIG. 3 but utilizing spaced reaches of flexible bonded filaments, separated by openings, to establish a discontinuous or interrupted flexible hinge between the mat elements.

Referring to FIG. 12, a mortar and debris collector embodying an ninth form of the present invention is indicated generally by the numeral 900. The collector 900 has mat elements 910, 920 that are identical to the mat elements 210, 220 of FIG. 3 and that are connected by a plurality of flexible filament formations 931 that cooperate to define a flexible hinge formation 930 that is a discontinuous or interrupted adaptation of the continuous, uninterrupted flexible hinge formation 230 of FIG. 3, and that permits the collector 900 to be folded to bring the mat elements 910, 920 into side-by-side engagement for insertion into a masonry wall cavity, such as the cavity 240 depicted in FIG. 4. The mat elements 910, 920 have pointed upper edge regions 911, 921 that terminate in pointed formations or "points" 913, 923; and have lower edge regions 917, 927 that are connected by the flexible hinge formation 930.

Figure 13:
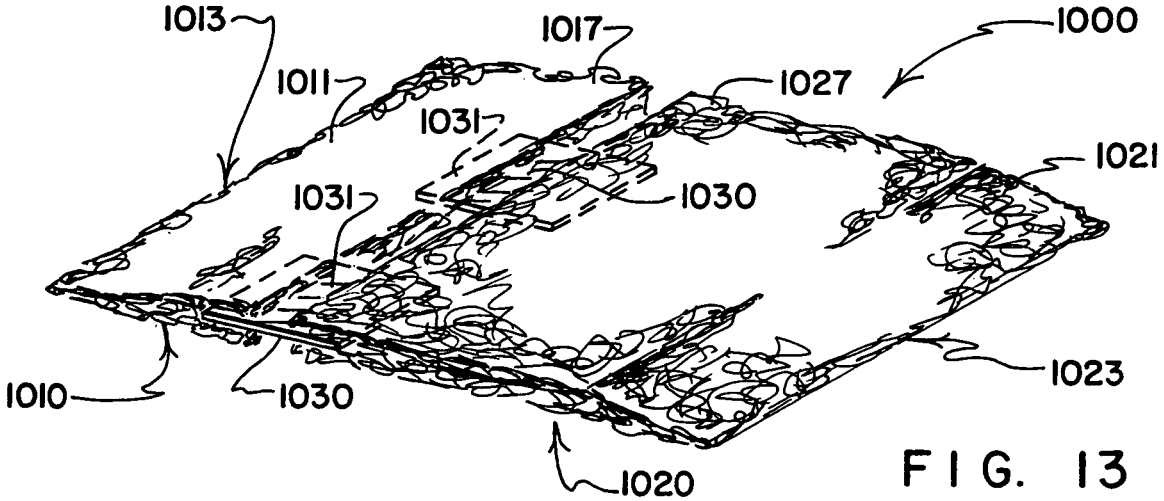
FIG. 13 is a perspective view similar to FIG. 5 but utilizing spaced reaches of flexible material that extends into edge portions of the mat elements, separated by openings, to establish a discontinuous or interrupted flexible hinge between the mat elements; and, FIG. 14 is a cross-sectional view depicting the collector installation of FIG. 2 but with none of the elements being spaced apart, and with the view showing mortar droppings and construction debris collected in the upwardly opening V-shaped trough of the collector.

Referring to FIG. 13, a mortar and debris collector embodying an tenth form of the present invention is indicated generally by the numeral 1000. The collector 1000 has mat elements 1010, 1020 that are identical to the mat elements 310, 320 of FIG. 5 and that are connected by a plurality of flexible filament formations 1031 that cooperate to define a flexible hinge formation 1030 that is a discontinuous or interrupted adaptation of the continuous, uninterrupted flexible hinge formation 330 of FIG. 5, and that permits the collector 1000 to be folded to bring the mat elements 1010, 1020 into side-by-side engagement for insertion into a masonry wall cavity, such as the cavity 340 depicted in FIG. 6. The mat elements 1010, 1020 have pointed upper edge regions 1011, 1021 that terminate in pointed formations or "points" 1013, 1023; and have lower edge regions 1017, 1027 that are connected by the flexible hinge formation 1030.

The masonry wall cavities 140, 240, 340, 440, 540, 640 and 740 depicted in FIGS. 2, 4, 6, 7, 8, 9 and 10, respectively, represent typical cavities of masonry cavity walls that include outer wall structures 142, 242, 342, 442, 542, 642 and 742 that are spaced by cavity widths "W" from inner wall structures 144, 244, 344, 444, 544, 644 and 744 situated atop foundations 146, 246, 346, 446, 546, 646 and 746, respectively. The cavity width "W" often is between about one and about three inches, but may be as narrow as about one inch or as wide as about five inches.

The outer wall structures 142, 242, 342, 442, 542, 642 and 742 typically are comprised of brick, concrete blocks, stone or other masonry elements laid in mortar in a conventional manner well known to those who are skilled in the art—with a course of brick 50 being illustrated in FIGS. 2, 4, 6 and 7-10. While a horizontal weep vent passage 55 is depicted at a location beneath the lowermost course of brick in FIGS. 2, 4, 6 and 7-10, those who are skilled in the art will readily understand that other types of weep vent passages may be provided at other locations through the outer wall structures 142, 242, 342, 442, 542, 642 and 742, as is well known. Interior surfaces of the mortared course of brick 50 provide cavity-facing surfaces 52 of the outer wall structures 142, 242, 342, 442, 542, 642 and 742, as is depicted in FIGS. 2, 4, 6 and 7-10.

Figure 2:
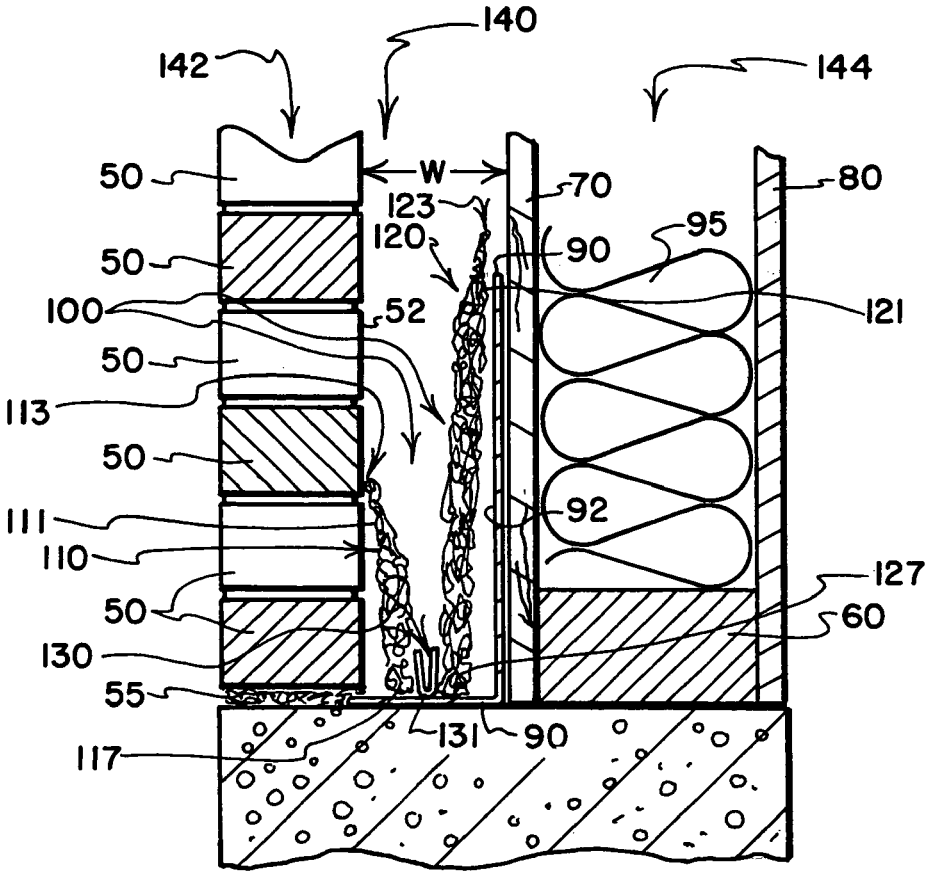
FIG. 2 is a cross-sectional view of a masonry cavity wall with the mortar and debris collector of FIG. 1 folded and installed in lower portions of the air space cavity of the wall to provide an upwardly opening trough of substantially V-shaped cross-section for holding mortar droppings and sizable construction debris at a central location spaced from where a typical weep vent passage is shown extending beneath the lowermost course of brick so as to open into lowermost portions of the cavity to drain moisture therefrom, with some of the elements spaced apart to enable their individual cross-sections to be viewed.
Figure 4:
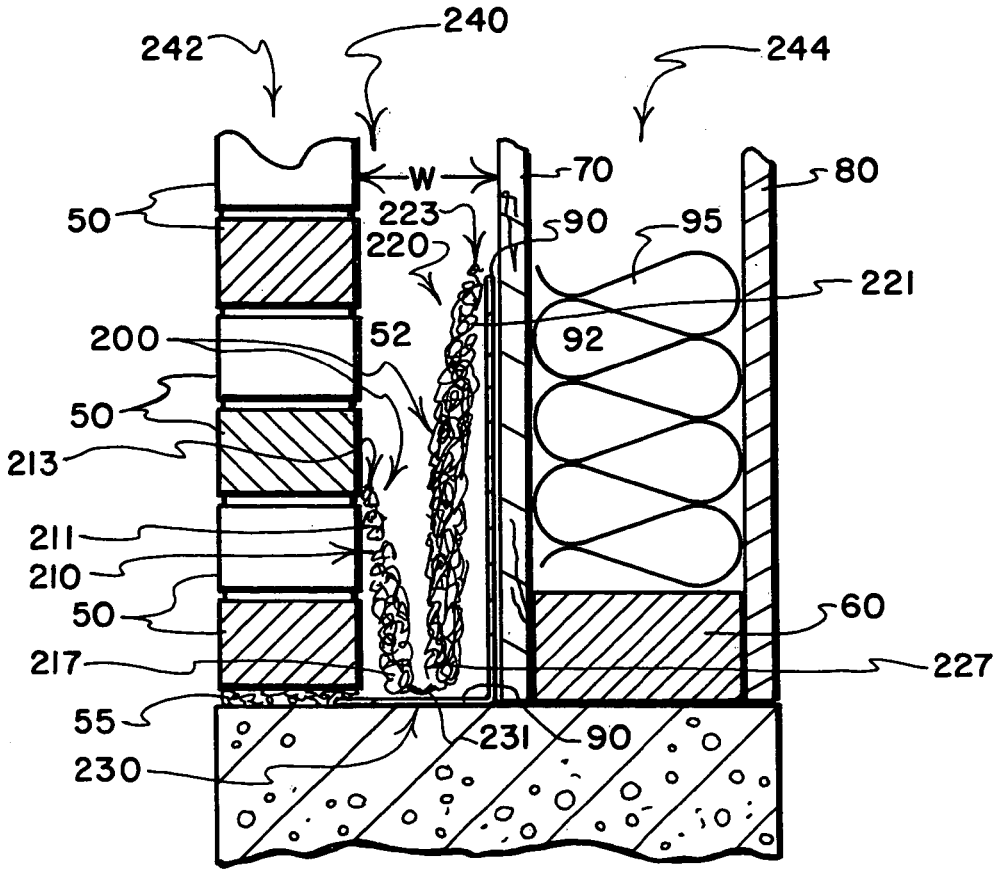
FIG. 4 is a cross-sectional view of a masonry cavity wall with the mortar and debris collector of FIG. 3 folded and installed in lower portions of the air space cavity of the wall to provide an upwardly opening trough of substantially V-shaped cross-section for holding mortar droppings and sizable construction debris at a central location spaced from where a typical weep vent passage is shown opening into lowermost portions of the cavity, with some of the elements spaced apart to enable their individual cross-sections to be distinguished one from another.
Figure 6:
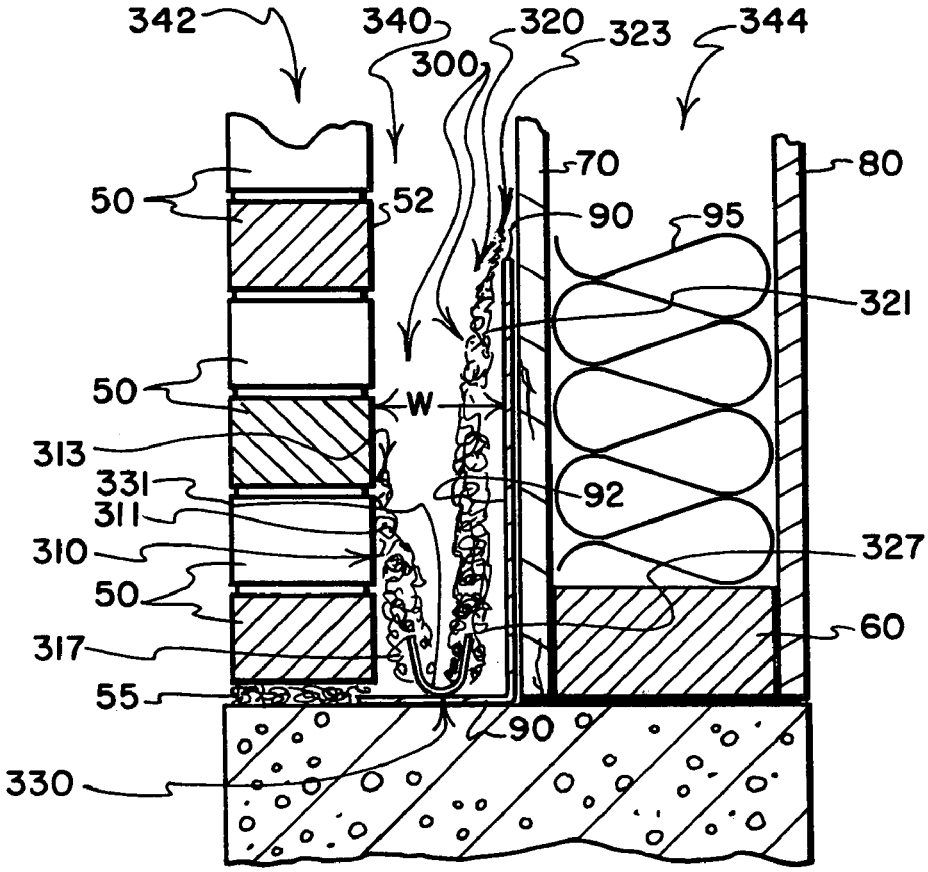
FIG. 6 is a cross-sectional view of a masonry cavity wall with the mortar and debris collector of FIG. 5 folded and installed in lower portions of the air space cavity of the wall to provide an upwardly opening trough of substantially V-shaped cross-section for holding mortar droppings and sizable construction debris at a central location spaced from where a typical weep vent passage is shown opening into lowermost portions of the cavity, with some of the elements spaced apart to enable their individual cross-sections to be distinguished one from another.

The inner wall structures 144, 244, 344, 444, 544, 644 and 744 typically are comprised of a wood framework (illustrated in part by a conventional two-by-four plate 60 in FIGS. 2, 4 and 6) covered on inner sides thereof by sheathing 70, as is depicted in FIGS. 2, 4, 6 and 7-10, and on outer sides thereof by drywall 80, as is depicted in FIGS. 2, 4 and 6. Membrane flashing or metal flashing may be provided to line about the lowermost ten inches of the inner wall structure, as indicated by the numeral 90 in FIGS. 2, 4 and 6-10; and, the flashing 90 also may line the bottom of the wall cavities 140, 240, 340, 440, 540, 640, 740. Where the flashing 90 lines lower portions of the inner wall structures 144, 244, 344, 444, 544, 644, 744, the flashing provides a cavity-facing surface 92. Insulation 95 may be housed between the sheathing 70 and the drywall 80 in the usual manner.

The mat elements 110, 120 of FIGS. 1 and 2; the mat elements 210, 220 of FIGS. 3 and 4; the mat elements 310, 320 of FIGS. 5 and 6; the mat elements 410, 420 of FIG. 7; the mat elements 510, 520 of FIG. 8; the mat elements 710, 720 of FIG. 10; the mat elements 810, 820 of FIG. 11; the mat elements 910, 920 of FIG. 12; and the mat elements 1010, 1020 of FIG. 13 all are depicted as being of substantially equal thickness, which preferably is in the range of about ⅝ inch to about 1¼ inch, with about ¾ inch being preferred. The mat elements 610, 620 of FIG. 9 are depicted as being thicker than the other ¾ inch thickness of the other mat elements, with a thickness of about ⅞ inch being depicted. What is important about the thickness of the two mat elements that are employed by any one of the collectors 100, 200, 300, 400, 500, 600, 700, 800, 900 or 1000 is that the thicknesses of the two mat elements of any one collected, when added together, should be less than eighty percent of the width "W" of the wall cavity into which the collector is to be inserted—to ensure ease of insertion, to ensure that the collector does not press outwardly with undue force on a newly laid course of masonry elements such as brick either during insertion or after being inserted, and to permit the mat elements of the collector to "unfold" (after being pressed together while being inserted into a masonry wall cavity) to properly define a trough of substantially V-shaped cross-section for collecting mortar droppings and sizable construction debris at a central location in the wall cavity spaced from where weep vent passages open into lowermost portions of the cavity for draining moisture from lowermost portions of the cavity.

While the mat elements that are employed in the collectors 100, 200, 300, 400, 500, 600, 700, 800, 900 and 1000 are depicted as being of equal and substantially uniform thickness, this need not be the case so long as the thicknesses of the two mat elements employed in any one of the collectors is less than eighty percent of the width of the wall cavity into which a particular collector is to be inserted—to provide for ease of insertion, to prevent the collector from applying undue pressure to a freshly laid course of masonry elements, and to permit the mat elements to unfold after the collector has been inserted to properly form an upwardly opening trough of generally V-shaped cross-section.

Figure 14:
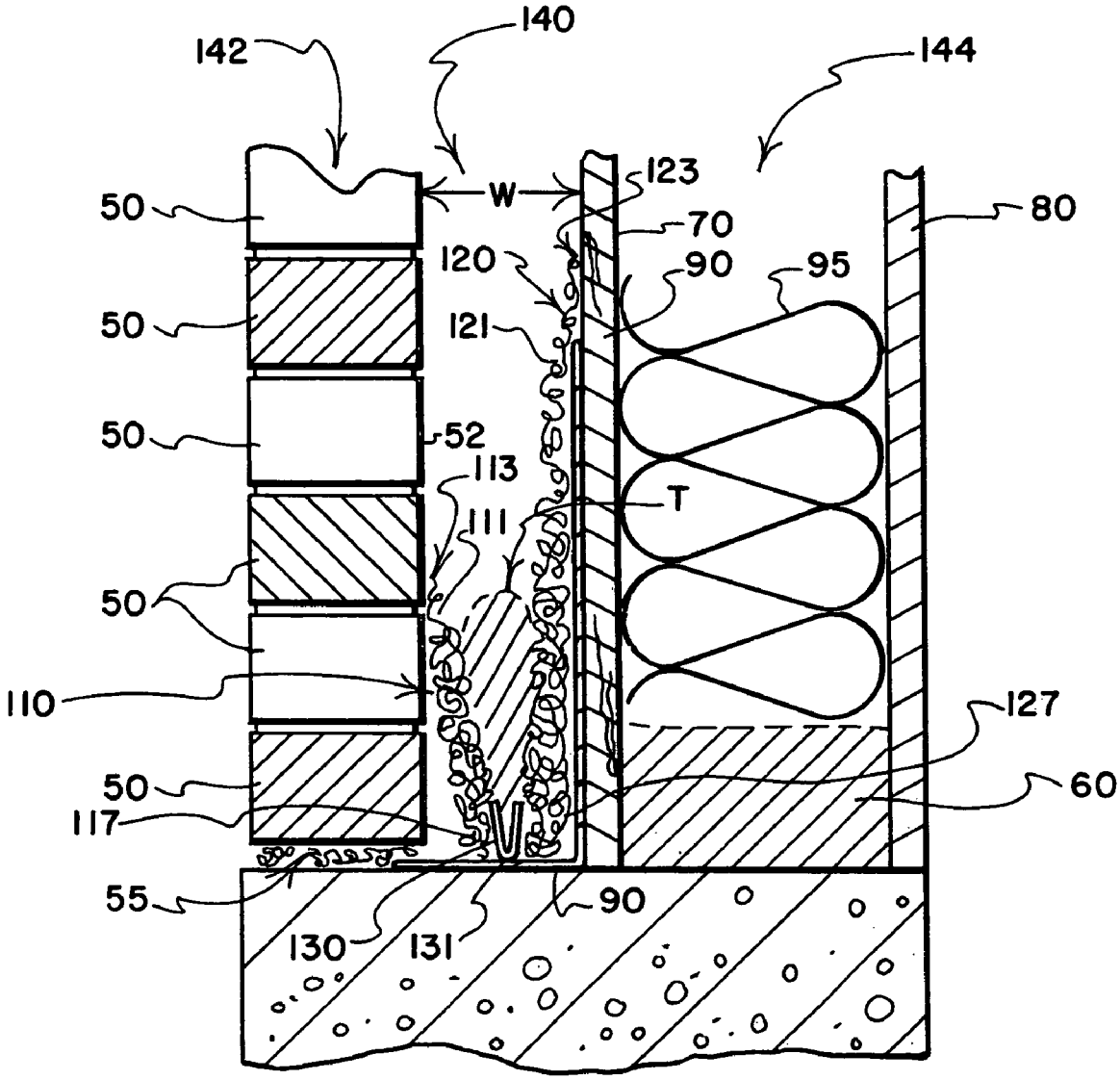

When the mat elements 110, 120 unfold, their pointed upper edge regions 111, 121 (and, more specifically the "points" 113, 123 of their pointed upper edge regions 111, 121) preferably engage cavity-facing inner surfaces of the outer and inner wall structures 142, 144, as is depicted in FIG. 14. What is stated in the previous sentence is true despite what is shown in FIG. 2 wherein the point 123 is depicted as being separated by a space from the cavity-facing inner surface of the inner wall structure 144—a space that is provided in FIG. 2 simply to enable the cross-section of an upwardly extending reach of flashing 90 to be seen. The flashing 90 normally extends closely along (so as to line about the bottom ten inches of the cavity-facing surface of) the inner wall structure 144, and there normally is no space at all between the pointed upper edge region 121 (in particular the point 123) and the inner surface of the inner wall structure 144.

Likewise, where spaces are shown in FIGS. 4 and 6-10 between points 223, 323, 423, 523, 623, 723 and the cavity-facing inner surfaces of the inner wall structures 244, 344, 444, 544, 644, 744, it will be understood that such spaces normally are not present, but are provided in FIGS. 4 and 6-10 merely to permit the cross-sections of reaches of flashing material 90 to be seen and distinguished from the cross-sections of other components.

What FIG. 14 also illustrates is the manner in which mortar and debris collectors of the present invention function to collect trash such as mortar droppings and construction debris "T" at a central location in a collector defined trough of generally V-shaped cross-section—a trough that does not permit much, if anything, in the way of mortar droppings or construction debris to engage, impact upon or collect adjacent to the membrane flashing or metal flashing 90 that normally lines approximately the lower ten inches of the inner surface of the associated inner wall structure and the bottom of the wall cavity in which the collector has been installed. Thus, it will be seen that the collector's mat elements provide paths for ventilation air to circulate along the inner and outer wall structures, provide paths for moisture to migrate downwardly toward weep vent passage openings, and serve to shield nearby reaches of sheathing from impact damage; while, at the same time, the pointed upper edge regions of the mat elements of the collector serve to divert mortar droppings and construction debris into the central collection chamber of the V-shaped trough and minimize the collection of droppings and debris at the top of the collector so that droppings and debris do not bridge between the cavity-facing inner surfaces of the outer and inner wall structures. In preferred practice, the width or vertical height of the mat element located adjacent the inner wall structure is sufficient to permit this mat element to protectively shield the adjacent vertical reach of flashing 90 from being impacted by droppings and debris.

The mat elements that are employed in the collectors 100, 200, 300, 400, 500, 600, 700, 800, 900 and 1000 are preferably relatively long so that the collectors preferably can be supplied in fifty foot rolls or in cut lengths several feet long. Regardless of whether the collectors are provided in roll form or in cut lengths, they can easily be cut to any desired length, as may be needed to accommodate a particular application.

The widths of the mat elements employed in the collectors 100, 200, 300, 400, 500, 600, 700, 800, 900 and 1000 preferably are no greater than about 20 inches, with widths of 5 and 10 inches (establishing a width ratio of 1:2 for the widths of the mat elements of a single one of the collectors) constituting one possible example of a collector that embodies features of the invention. Widths of 5 and 15 inches (establishing a width ratio of 1:3 for the widths of the mat elements of a collector), and other widths establishing other width ratios, also may be used. In FIG. 8, for example a 1:1 width ratio (equal widths) is illustrated. In FIG. 9, a 2:3 width ratio is depicted.

A variety of approaches may be taken to establish a flexible hinge formation between the two mat elements of the collectors 100, 200, 300, 400, 500, 600, 700, 800, 900 and 1000. As depicted in FIGS. 1, 2 and 11, one approach utilizes a single reach 131 (FIGS. 1 and 2) or plural, spaced reaches 831 (FIG. 11) of thin flexible material that overlies and is bonded to adjacent edge regions 105, 115 or 805, 815 of the mat elements 110, 120 or 810, 820 of the collectors 100, 800. While any of a wide variety of fungus- and mold-resistant materials may be used to form the flexible materials 130, 830, materials formed from tangled glass or tangled polymer fibers are preferred.

As depicted in FIGS. 3, 4 and 12, another approach utilizes a single reach 231 (FIGS. 3 and 4) or plural reaches 931 (FIG. 12) of polymer filaments that are bonded while being clamped together so as to define flexible regions 230 or 930 that extend lengthwise between two mat elements 210, 220 or 910, 920.

As depicted in FIGS. 5, 6 and 13, still another approach utilizes a single reach 331 (FIGS. 5 and 6) or plural reaches 1031 (FIG. 13) of flexible material that extends into and is bonded to adjacent edge regions 305, 315 or 1005, 1015 of the mat elements 310, 320 or 1010, 1020 of the collectors 300, 1000. While any of a wide variety of fungus- and mold-resistant materials may be used to form the flexible materials 330, 1030, materials formed from tangled glass or tangled polymer fibers are preferred.

In preferred practice, the mat elements of the collectors 100, 200, 300, 400, 500, 600, 700, 800, 900 and 1000 preferably are formed from polymer filaments that are spaced apart along lengths that twist and turn substantially randomly among intersections where the filaments are bonded together. In preferred practice, the polymer filaments are extruded and heat bonded at their intersections to form open-space mats that are relatively rigid and capable of supporting not only their own weight but also the loads that are imposed on the mats when a typical amount of mortar droppings and occasional pieces of construction debris fall down through the cavities of masonry cavity walls and onto the collectors 100, 200, 300, 400, 500, 600, 700, 800, 900 and 1000.

The filaments or fibers used to form the mat elements of the collectors 100, 200, 300, 400, 500, 600, 700, 800, 900 and 1000 may be of any suitably strong and mildew resistant polymeric material, including but not limited to polyethylenes, polypropylenes and other polyolefins; polyamides; polyvinyl chlorides; and other thermoplastic polymers, with the filaments being heat bonded or otherwise suitably connected where the filaments randomly intersect.

Polymeric filaments are preferred for the inter-tangled mass that forms the mat elements 110, 120, 210, 220, 310, 320, 410, 420, 510, 520, 610, 620, 710, 720, 810, 820, 910, 920, 1010, 1020, as illustratively shown by U.S. patents to Voigtman U.S. Pat. No. 2,897,109 or Sylvest U.S. Pat. No. 4,315,392, the disclosures of which are incorporated herein by reference. The material from which the mat 16 is formed may agree with what is depicted in FIG. 14 of Sourlis U.S. Pat. Nos. 5,230,189, 5,343,661 and RE-36,676, and may be consistent with what is disclosed in these patents about such material, the disclosures of which patents are incorporated herein by reference. It is within the scope of the invention to employ other materials now known and hereafter existing that are capable of fulfilling the requisite structure and function, to provide an open matrix of material that will perform as described.

In preferred practice, the filaments that form the mat structures of the collectors 100, 200, 300, 400, 500, 600, 700, 800, 900 and 1000, and the materials that are used to provide the flexible hinge formations of the collectors 100, 200, 300, 400, 500, 600, 700, 800, 900 and 1000 preferably are treated with at least one of an anti-microbial agent and an anti-fungal agent.

As will be apparent from the foregoing description and the accompanying drawings, the present invention provides a dual-mat-element foldable collection device that can be folded to bring the mat elements thereof into closely overlying relationship for being easily inserted into lower portions of the cavity of a masonry cavity wall, and that expands, opens or unfolds after being inserted in a hinge-formation-down orientation to provide an upwardly opening trough of generally V-shape cross-section for catching and holding mortar and debris at a central location spaced above where weep vent passages open into the cavity so as to keep the collected mortar and debris from blocking openings of the weep vents into the cavity, with the mat elements being pervious to moisture so as to permit moisture to move downwardly therethrough toward the weep vent passage openings. In preferred practice, the flexible hinge formation that joins the two relatively rigid mat elements is sufficiently short or is otherwise configured so that, when the mat elements are pressed closely together for insertion, they are biased either by the shortness or other characteristics of the hinge formation (such as its stiffness or its "memory") so that the mat elements open or unfold after insertion to thereby bridge the width of the cavity in which the collection device has been inserted. This hinged, dual-mat, self-unfolding type of collector differs significantly from what is taught or suggested by the prior art.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

The invention claimed is:

1. A mortar and debris collection device comprising first and second substantially rigid mat elements connected by a flexible hinge formation that permits the mat elements to be folded into closely overlying relationship for insertion in a hinge-formation-down orientation into lower portions of a cavity between an outer wall structure and an inner wall structure of a masonry cavity wall where the device unfolds to form an upwardly opening generally V-shaped trough for catching mortar droppings and construction debris at locations spaced from where weep vent passages formed through the outer wall structure open into lowermost portions of the cavity, and wherein the mat elements are pervious to moisture and permit moisture to pass downwardly through lower cavity portions toward where the weep vent passages open into the cavity for discharge from the cavity through the weep vent passages;

wherein at least one of the mat elements is defined by an open-space defining array of polymer filaments that twist and turn between filament intersections where adjacent ones of the filaments are bonded to each other, the polymer filaments comprising polyolefin filaments or polyamide filaments;

wherein the first mat element has a thickness which comes to a pointed upper edge region configured to engage a selected one of the inner and outer wall structures when the device unfolds, the pointed upper edge region of the first mat element being tapered to form an acute angle within the range of about 45 degrees to about 30 degrees;

and/or the second mat element has a thickness which comes to a pointed upper edge region configured to engage the other of the inner and outer wall structures when the device unfolds, the pointed upper edge region of the second mat element being tapered to form an acute angle within the range of about 45 degrees to about 30 degrees.

2. The device of claim 1 wherein each of the first and second mat elements has an open-space defining array of polymer filaments that twist and turn between filament intersections where adjacent ones of the filaments are bonded to each other.

3. The device of claim 1 wherein the flexible hinge formation extends along common lengths of the first and second mat elements to provide a hinged connection therebetween, and wherein when the mat elements are folded into closely overlying relationship, the thickness of the folded mat elements is less than eighty percent of the width of the cavity into which the device is to be inserted.

4. The device of claim 1 wherein the first mat element has a first width, the second mat element has a second width, and one of the first and second widths is substantially twice that of the other of the first and second widths.

5. The device of claim 1 wherein the first mat element has a first width, wherein the second mat element has a second width, and the first and second widths are substantially equal.

6. The of claim 1 wherein the hinge formation extends substantially continuously along side-by-side extending lengths of the first and second mat elements.

7. The device of claim 1 wherein the hinge formation extends along spaced portions of the lengths of the first and second mat elements.

8. The device of claim 1 wherein the first and second mat elements have substantially identical lengths along which the flexible hinge formation establishes a hinged connection between the first and second mat elements, and the first and second mat elements are formed from polymer filaments that extend in random directions between intersections where the filaments are bonded.

9. A mortar and debris collection device insertable into lower portions of a cavity defined between outer and inner wall structures of a masonry cavity wall to form an upwardly opening trough of generally V-shaped cross-section for catching mortar droppings and sizable construction debris at locations spaced from where weep vent passages formed through the outer wall structure open into lowermost portions of the cavity, comprising first and second relatively rigid mat elements coupled by a hinge connection that permits the relatively rigid mat elements to be pivoted about the hinge connection to a folded position wherein the mat elements closely overlie each other so as to be easily inserted into the lower portions of the cavity where portions of the first and second mat elements at positions spaced from the hinge connection engage opposed cavity-facing surface portions of the outer and inner wall structures to define an upwardly opening collection trough of substantially V-shaped cross-section that substantially bridges between the outer and inner wall structures for receiving and holding mortar droppings and construction debris at a central location spaced from the outer and inner wall structures and from where said weep vent passages open into said lowermost portions of the cavity, and wherein the mat elements permit moisture to pass therethrough as moisture migrates downwardly through the cavity and into the weep vent passage openings for discharge from the cavity through the weep vent passages;

wherein at least one of the mat elements is defined by an open-space defining array of polymer filaments that twist and turn between filament intersections where adjacent ones of the filaments are bonded to each other, the polymer filaments comprising polyolefin filaments or polyamide filaments;

wherein the first mat element has a thickness which comes to a pointed upper edge region configured to engage a selected one of the inner and outer wall structures when the device unfolds, the pointed upper edge region of the first mat element being tapered to form an acute angle within the range of about 45 degrees to about 30 degrees;

and/or the second mat element has a thickness which comes to a pointed upper edge region configured to engage the other of the inner and outer wall structures when the device unfolds, the pointed upper edge region of the second mat element being tapered to form an acute angle within the range of about 45 degrees to about 30 degrees.

10. The device of claim 9 wherein:

a) the first mat element has a first length and a first width measured transversely with respect to the first length, and has a first edge region of the first mat element that extends along the first length;

b) the second mat element has a second length and a second width measured transversely with respect to the second length, and has a second edge region of the second mat element that extends along the second length; and, c) the hinge connection extends along the first and second lengths to hingedly connect at least selected portions of the first edge region to at least selected portions of the second edge region.

11. The device of claim 10 wherein the first and second widths are substantially equal.

12. The device of claim 10 wherein one of the first and second widths is substantially twice that of the other of the first and second widths.

13. The device of claim 10 wherein one of the first and second widths is substantially three times that of the other of the first and second widths.

14. The device of claim 9 wherein the hinge formation extends substantially continuously along side-by-side extending lengths of the first and second mat elements.

15. The device of claim 9 wherein the hinge formation extends along spaced portions of the lengths of the first and second mat elements.

16. The device of claim 9 wherein the first and second mat elements have substantially identical lengths along which the flexible hinge formation establishes a hinged connection between the first and second mat elements, and the first and second mat elements are formed from polymer filaments that extend in random directions between intersections where the filaments are bonded.

17. A mortar and debris collection device for use in lower portions of a cavity defined between an outer wall structure and an inner wall structure of a masonry cavity wall to define an upwardly opening trough of generally V-shaped cross-section for catching mortar droppings and sizable construction debris at a central location spaced from where weep vent passages formed through lowermost portions of the outer wall structure open into the cavity, wherein the cavity has a width measured between opposed cavity-facing surfaces of the outer and inner wall structures, comprising:

a) a first reach of relatively rigid mat formed from a first set of polymeric filaments that are spaced from each other along a majority of their lengths and that are connected at intersections thereof so as to define a first open-space mat having a relatively long first length and having a first transverse cross-section that is bordered by opposed first edges that are defined by selected portions of the first set of filaments, and by opposed first sides that are defined by other portions of the first set of filaments, with a majority of said other portions of the first set of filaments extending in one or the other of a pair of substantially parallel-extending first planes so as to give the first mat a substantially uniform first thickness except where a first pointed upper edge region is defined;

b) a second reach of relatively rigid mat formed from a second set of polymeric filaments that are spaced from each other along a majority of their lengths and that are connected at intersections thereof so as to define a second open-space mat having a relatively long second length and having a second transverse cross-section that is bordered by opposed second edges that are defined by selected portions of the second set of filaments, and by opposed second sides that are defined by other portions of the second set of filaments, with a majority of said other portions of the second set of filaments extending in one or the other of a pair of substantially parallel-extending second planes so as to give the second mat a substantially uniform second thickness except where a second pointed upper edge region is defined;

c) with the first mat thickness and the second mat thickness, when added together, totalling less than eighty percent of the width of the cavity of the masonry wall;

d) with the first open-space mat having a first bottom edge portion extending along one of the first edges that is flexibly connected by at least one hinge formation to a second bottom edge portion of the second open-space mat that extends along one of the second edges for permitting relative movement of the first and second mats about the hinge formation between a substantially flat orientation wherein the first and second mats extend side-by-side substantially in a common plane, and a folded orientation wherein the first and second mats overlie each other to permit the device to be easily inserted into lower portions of the cavity in a hinge-connection-down orientation, with the first and second pointed upper edge regions of the inserted device being configured to extend into engagement with the opposed cavity-facing surfaces of the outer and inner wall structures at locations spaced from the hinge connection so as to give the inserted device a substantially V-shaped cross-section that bridges between the opposed cavity-facing surfaces of the outer and inner wall structures.

18. The device of claim 17 wherein the filaments of at least one of the first and second sets of filaments twist and turn randomly as they extend among intersections that are randomly located.

19. The device of claim 17 wherein the filaments of at least one of the first and second sets of filaments are comprised of extruded polymer that is heat bonded to connect the filaments at said intersections.

20. The device of claim 19 wherein the polymer is selected from among a group consisting of polyolefins, polyamides and polyvinyl chlorides.

21. The device of claim 17 wherein the filaments of the first and second open-space mats are treated with at least one of an anti-microbial agent and an antifungal agent.

22. The device of claim 17 wherein the first mat has a first width measured between the opposed first edges thereof, the second mat has a second width measured between the opposed second edges thereof, and the first width is substantially equal to the second width.

23. The device of claim 17 wherein the first mat has a first width measured between the opposed first edges thereof, the second mat has a second width measured between the opposed second edges thereof, and the first width is unequal to the second width.

24. The device of claim 17 wherein a selected one of the first and second mats has a width sufficient to shield a reach of flashing material that lines a lower portion of the inner wall structure, and the selected one of the first and second mats is positioned in the cavity so as to shield said reach of flashing material.

25. The device of claim 17 wherein the hinge formation extends substantially continuously along side-by-side extending lengths of the first and second mats.

26. The device of claim 17 wherein the hinge formation extends along spaced portions of the lengths of the first and second mats.

27. A mortar and debris collection device having polymer filaments that define substantially rigid, substantially flat, first and second mat elements, and having a flexible hinge formation extending between and connecting the first and second mat elements for movement relative to each other about the flexible hinge formation to a folded position wherein the first and second mat elements closely overlie each other so as to permit the device, with the first and second mat elements in the folded position, to be inserted into lower portions of a cavity between outer and inner wall structures of a masonry cavity wall in a hinge-formation-down orientation, with the first and second mat structures of the inserted device cooperating to define an upwardly opening trough of substantially V-shaped cross section that bridges between opposed cavity-facing surface portions of the outer and inner wall structures to catch mortar droppings and sizable construction debris at locations spaced from where weep vent passages formed through the outer wall structure open into lowermost portions of the cavity, and with the first and second mat elements each having at least a portion thereof defined by polymer filaments that twist and turn between junctures where adjacent filaments are connected so as to define open-space structures through which moisture can pass on its way toward the weep vent passage openings; the polymer filaments comprising polyolefin filaments or polyamide filaments;

wherein the first mat element has a thickness which comes to a pointed upper edge region configured to engage a selected one of the inner and outer wall structures when the device unfolds, the pointed upper edge region of the first mat element being tapered to form an acute angle within the range of about 45 degrees to about 30 degrees;

and/or the second mat element has a thickness which comes to a pointed upper edge region configured to engage the other of the inner and outer wall structures when the device unfolds, the pointed upper edge region of the second mat element being tapered to form an acute angle within the range of about 45 degrees to about 30 degrees.

28. A mortar and debris collection device comprising first anti second substantially rigid mat elements connected by a flexible hinge formation that permits the mat elements to be folded into closely overlying relationship for insertion in a hinge-formation-down orientation into lower portions of a cavity between an outer wall structure and an inner wall structure of a masonry cavity wall where the device unfolds to form an upwardly opening generally V-shaped trough for catching mortar droppings and construction debris at locations spaced from where weep vent passages formed through the outer wall structure open into lowermost portions of the cavity, and wherein the mat elements are pervious to moisture and permit moisture to pass downwardly through lower cavity portions toward where the weep vent passages open into the cavity for discharge from the cavity through the weep vent passages;

wherein the first mat element has a first width, wherein the second mat element has a second width, and the first and second widths are unequal;

wherein the first mat element has a thickness which comes to a pointed upper edge region configured to engage a selected one of the inner and outer wall structures when the device unfolds, the pointed upper edge region of the first mat element being tapered to form an acute angle within the range of about 45 degrees to about 30 degrees;

and/or the second mat element has a thickness which comes to a pointed upper edge region configured to engage the other of the inner and outer wall structures when the device unfolds, the pointed upper edge region of the second mat element being tapered to form an acute angle within the range of about 45 degrees to about 30 degrees.

29. A mortar and debris collection device comprising first and second substantially rigid mat elements connected by a flexible hinge formation that permits the mat elements to be folded into closely overlying relationship for insertion in a hinge-formation-down orientation into lower portions of a cavity between an outer wall structure and an inner wall structure of a masonry cavity wall where the device unfolds to form an upwardly opening generally V-shaped trough for catching mortar droppings and construction debris at locations spaced from where weep vent passages formed through the outer wall structure open into lowermost portions of the cavity, and wherein the mat elements are pervious to moisture and permit moisture to pass downwardly through lower cavity portions toward where the weep vent passages open into the cavity for discharge from the cavity through the weep vent passages;

wherein a selected one of the first and second mat elements has a width sufficient to shield a reach of flashing material that lines a lower portion of the inner wall structure, and the selected one of the first and second mat elements is positioned in the cavity so as to shield said reach of flashing material;

wherein the first mat element has a thickness which comes to a pointed upper edge region configured to engage a selected one of the inner and outer wall structures when the device unfolds, the pointed upper edge region of the first mat element being tapered to form an acute angle within the range of about 45 degrees to about 30 degrees;

and/or the second mat element has a thickness which comes to a pointed upper edge region configured to engage the other of the inner and outer wall structures when the device unfolds, the pointed upper edge region of the second mat element being tapered to form an acute angle within the range of about 45 degrees to about 30 degrees.

30. A mortar and debris collection device comprising first and second substantially rigid mat elements connected by a flexible hinge formation that permits the mat elements to be folded into closely overlying relationship for insertion in a hinge-formation-down orientation into lower portions of a cavity between an outer wall structure and an inner wall structure of a masonry cavity wall where the device unfolds to form an upwardly opening generally V-shaped trough for catching mortar droppings and construction debris at locations spaced from where weep vent passages formed through the outer wall structure open into lowermost portions of the cavity, and wherein the mat elements are pervious to moisture and permit moisture to pass downwardly through lower cavity portions toward where the weep vent passages open into the cavity for discharge from the cavity through the weep vent passages;

wherein one of the first and second mat elements has a thickness which comes to a pointed upper edge region configured to engage a selected one of the inner and outer wall structures when the device unfolds;

wherein the pointed upper edge region is tapered to form an acute angle within the range of about 45 degrees to about 30 degrees.

31. A mortar and debris collection device comprising first and second substantially rigid mat elements connected by a flexible hinge formation that permits the mat elements to be folded into closely overlying relationship for insertion in a hinge-formation-down orientation into lower portions of a cavity between an outer wall structure and an inner wall structure of a masonry cavity wall where the device unfolds to form an upwardly opening generally V-shaped trough for catching mortar droppings and construction debris at locations spaced from where weep vent passages formed through the outer wall structure open into lowermost portions of the cavity, and wherein the mat elements are pervious to moisture and permit moisture to pass downwardly through lower cavity portions toward where the weep vent passages open into the cavity for discharge from the cavity through the weep vent passages;

wherein the first mat element has a thickness which comes to a first pointed upper edge region configured to engage a selected one of the inner and outer wall structures when the device unfolds, and the second mat element has a thickness which comes to a second pointed upper edge region configured to engage the other of the inner and outer wall structures when the device unfolds; and wherein each of the first and second pointed upper edge regions is tapered to form an acute angle within the range of about 45 degrees to about 30 degrees.

32. A mortar and debris collection device insertable into lower portions of a cavity defined between outer and inner wall structures of a masonry cavity wall to form an upwardly opening trough of generally V-shaped cross-section for catching mortar droppings and sizable construction debris at locations spaced from where weep vent passages formed through the outer wall structure open into lowermost portions of the cavity, comprising first and second relatively rigid mat elements coupled by a hinge connection that permits the relatively rigid mat elements to be pivoted about the hinge connection to a folded position wherein the mat elements closely overlie each other so as to be easily inserted into the lower portions of the cavity where portions of the first and second mat elements at positions spaced from the hinge connection engage opposed cavity-facing surface portions of the outer and inner wall structures to define an upwardly opening collection trough of substantially V-shaped cross section that substantially bridges between the outer and inner wall structures for receiving and holding mortar droppings and construction debris at a central location spaced from the outer and inner wall structures and from where said weep vent passages open into said lowermost portions of the cavity, and wherein the mat elements permit moisture to pass therethrough as moisture migrates downwardly through the cavity and into the weep vent passage openings for discharge from the cavity through the weep vent passages;

wherein: a) the first mat element has a first length and a first width measured transversely with respect to the first length, and has a first edge region of the first mat element that extends along the first length;

b) the second mat element has a second length and a second width measured transversely with respect to the second length, and has a second edge region of the second mat element that extends along the second length; and, c) the hinge connection extends along the first and second lengths to hingedly connect at least selected portions of the first edge region to at least selected portions of the second edge region; and wherein the first and second widths are unequal; wherein the first mat element has a thickness which comes to a pointed upper edge region configured to engage a selected one of the inner and outer wall structures when the device unfolds, the pointed upper edge region of the first mat element being tapered to form an acute angle within the range of about 45 degrees to about 30 degrees; and/or the second mat element has a thickness which comes to a pointed upper edge region configured to engage the other of the inner and outer wall structures when the device unfolds, the pointed upper edge region of the second mat element being tapered to form an acute angle within the range of about 45 degrees to about 30 degrees.

33. A mortar and debris collection device insertable into lower portions of a cavity defined between outer and inner wall structures of a masonry cavity wall to form an upwardly opening trough of generally V-shaped cross-section for catching mortar droppings and sizable construction debris at locations spaced from where weep vent passages formed through the outer wall structure open into lowermost portions of the cavity, comprising first and second relatively rigid mat elements coupled by a hinge connection that permits the relatively rigid mat elements to be pivoted about the hinge connection to a folded position wherein the mat elements closely overlie each other so as to be easily inserted into the lower portions of the cavity where portions of the first and second mat elements at positions spaced from the hinge connection engage opposed cavity-facing surface portions of the outer and inner wall structures to define an upwardly opening collection trough of substantially V-shaped cross-section that substantially bridges between the outer and inner wall structures for receiving and holding mortar droppings and construction debris at a central location spaced from the outer and inner wall structures and from where said weep vent passages open into said lowermost portions of the cavity, and wherein the mat elements permit moisture to pass therethrough as moisture migrates downwardly through the cavity and into the weep vent passage openings for discharge from the cavity through the weep vent passages;

wherein a selected one of the first and second mat elements has a width sufficient to shield a reach of flashing material that lines a lower portion of the inner wall structure, and the selected one of the first and second mat elements is positioned in the cavity so as to shield said reach of flashing material;

wherein the first mat element has a thickness which comes to a pointed upper edge region configured to engage a selected one of the inner and outer wall structures when the device unfolds, the pointed upper edge region of the first mat element being tapered to form an acute angle within the range of about 45 degrees to about 30 degrees;

and/or the second mat element has a thickness which comes to a pointed upper edge region configured to engage the other of the inner and outer wall structures when the device unfolds, the pointed upper edge region of the second mat element being tapered to form an acute angle within the range of about 45 degrees to about 30 degrees.

34. A mortar and debris collection device insertable into lower portions of a cavity defined between outer and inner wall structures of a masonry cavity wall to form an upwardly opening trough of generally V-shaped cross-section for catching mortar droppings and sizable construction debris at locations spaced from where weep vent passages formed through the outer wall structure open into lowermost portions of the cavity, comprising first and second relatively rigid mat elements coupled by a hinge connection that permits the relatively rigid mat elements to be pivoted about the hinge connection to a folded position wherein the mat elements closely overlie each other so as to be easily inserted into the lower portions of the cavity where portions of the first and second mat elements at positions spaced from the hinge connection engage opposed cavity-facing surface portions of the outer and inner wall structures to define an upwardly opening collection trough of substantially V-shaped cross-section that substantially bridges between the outer and inner wall structures for receiving and holding mortar droppings and construction debris at a central location spaced from the outer and inner wall structures and from where said weep vent passages open into said lowermost portions of the cavity, and wherein the mat elements permit moisture to pass therethrough as moisture migrates downwardly through the cavity and into the weep vent passage openings for discharge from the cavity through the weep vent passages;

wherein one of the first and second mat elements has a thickness which comes to a pointed upper edge region configured to engage a selected one of the inner and outer wall structures when the device unfolds;

wherein the pointed upper edge region is tapered to form an acute angle within the range of about 45 degrees to about 30 degrees.

35. A mortar and debris collection device insertable into lower portions of a cavity defined between outer and inner wall structures of a masonry cavity wall to form an upwardly opening trough of generally V-shaped cross-section for catching mortar droppings and sizable construction debris at locations spaced from where weep vent passages formed through the outer wall structure open into lowermost portions of the cavity, comprising first and second relatively rigid mat elements coupled by a hinge connection that permits the relatively rigid mat elements to be pivoted about the hinge connection to a folded position wherein the mat elements closely overlie each other so as to be easily inserted into the lower portions of the cavity where portions of the first and second mat elements at positions spaced from the hinge connection engage opposed cavity-facing surface portions of the outer and inner wall structures to define an upwardly opening collection trough of substantially V-shaped cross-section that substantially bridges between the outer and inner wall structures for receiving and holding mortar droppings and construction debris at a central location spaced from the outer and inner wall structures and from where said weep vent passages open into said lowermost portions of the cavity, and wherein the mat elements permit moisture to pass therethrough as moisture migrates downwardly through the cavity and into the weep vent passage openings for discharge from the cavity through the weep vent passages;

wherein the first mat element has a thickness which comes to a first pointed upper edge region configured to engage a selected one of the inner and outer wall structures when the device unfolds, and the second mat element has a thickness which comes to a second pointed upper edge region configured to engage the other of the inner and outer wall structures when the device unfolds;

wherein each of the first and second pointed upper edge regions is tapered to form an acute angle within the range of about 45 degrees to about 30 degrees.

* * * * *